United States Patent [19]

Steiner

[11] Patent Number: 4,576,208

[45] Date of Patent: Mar. 18, 1986

[54] WEFT SEVERING DEVICE FOR A WEAVING MACHINE

[75] Inventor: Alois Steiner, Rieden, Switzerland

[73] Assignee: Sulzer Brothers Limited, Winterthur, Switzerland

[21] Appl. No.: 675,235

[22] Filed: Nov. 27, 1984

[30] Foreign Application Priority Data

Dec. 1, 1983 [EP] European Pat. Off. ..... 83.112063.9

[51] Int. Cl.[4] ..... D03D 47/00

[52] U.S. Cl. ..... 139/429; 139/435; 139/302

[58] Field of Search ..... 139/302, 435, 429, 450, 139/28, 116, 194, 303, 452; 226/97

[56] References Cited

U.S. PATENT DOCUMENTS

| | | | |
|---|---|---|---|
| 3,229,725 | 1/1966 | Saito | 139/435 |
| 3,310,073 | 3/1967 | Claeys | 139/194 |
| 3,487,436 | 12/1969 | Svaty | 139/450 |
| 3,530,902 | 9/1970 | Stingl | 139/429 |
| 4,134,434 | 1/1979 | Málasek | 139/429 |
| 4,275,773 | 6/1981 | Shibata | 139/429 |
| 4,415,009 | 11/1983 | Shaw | 139/435 |

FOREIGN PATENT DOCUMENTS

| | | |
|---|---|---|
| 83748 | 7/1983 | European Pat. Off. . |
| 38755 | 4/1978 | Japan . |

*Primary Examiner*—Henry S. Jaudon
*Attorney, Agent, or Firm*—Kenyon & Kenyon

[57] ABSTRACT

The weft severing device is used for superposed shed type weaving machines and has at least one shear which has a blowing tube. The tube is supplied with blowing air to convey the weft thread. To sever the weft thread, the blowing tube is moved into the cutting element after the weaving rotor has drawn the weft thread over the mouth of the blowing tube.

9 Claims, 5 Drawing Figures

WEFT SEVERING DEVICE FOR A WEAVING MACHINE

This invention relates to a weft severing device for a weaving machine. More particularly, this invention relates to a weft severing device for use in a superposed shed type weaving machine.

As is known, weaving machines of the superposed shed type are frequently provided with a multiplicity of weft thread supply devices. Accordingly, such weaving machines usually require a severing device having a shear for each individual weft with the various shears performing a severing movement in consecutive fashion. However, it has been found that the known severing devices have not been quick acting. Further, in some cases, the weft severing device have been of relatively considerable bulk and of complex construction.

Accordingly, it is an object of the invention to provide a weft severing device for a superposed shed type weaving machine which is quick acting.

It is another object of the invention to provide a weft severing device for a weaving machine which is of relatively low weight and of simple construction.

Briefly, the invention provides a weft severing device for a weaving machine, for example of the superposed shed type, which is comprised of a blowing tube for pneumatically conveying a weft thread therethrough, a cutting element for severing a weft thread extending out of the tube and means for moving at least one of the tube and element relative to each other in order to effect severing of a weft thread between the tube and element.

In one embodiment, the cutting element is in the form of a plate having a bore for receiving a mouth of the blowing tube as well as a cutting edge about the bore for severing a thread extending between the mouth and the cutting edge. In this embodiment, the mouth of the blowing tube is moved into the cutting element so that a weft thread extending transversely of the mouth of the tube can be severed between the tube and the cutting element.

In another embodiment, the blowing tube is slidably mounted in a guide element from which the cutting element extends at one end. In addition, the cutting element is provided with a recess to accommodate a weft thread extending from the mouth of the blowing tube. In addition, the cutting edge of the cutting element is disposed to face a cutting edge on the end of the blowing tube so as to sever a weft thread therebetween when the tube is moved relative to the cutting element.

These and other objects and advantages of the invention will become more apparent from the following detailed description taken in conjunction with the accompanying drawings wherein.

Figure 1:
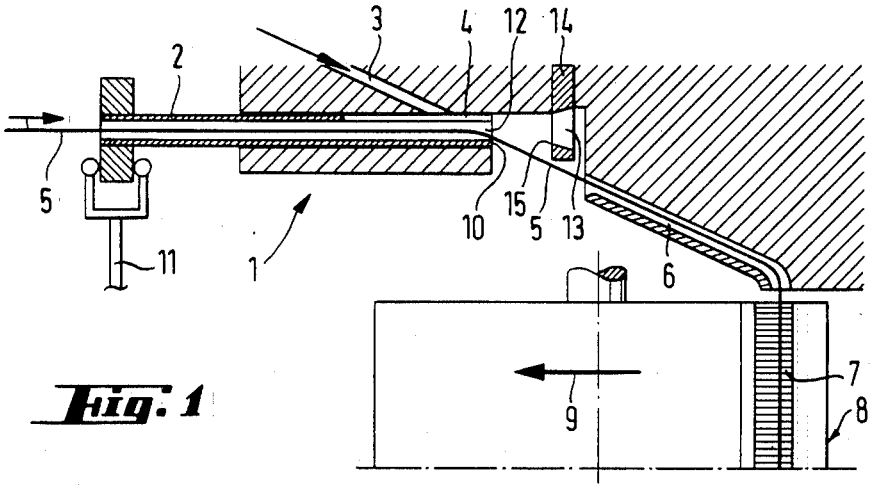
FIG. 1 illustrates a cross-sectional view through a shear of a severing device constructed in accordance with the invention in an initial position.

Referring to FIG. 1, the weft severing device 1 has a blowing tube 2 which is slidably mounted in a suitable support having a duct 3 through with compressed air is continuously supplied to the interior of the tube via a slot 4 in a wall of the tube 2. As indicated, the blowing tube 2 pneumatically conveys a weft thread 5 therethrough. To this end, the weft thread 5 is sucked into the tube 2 by the air which is blown into the tube 2 via the duct 3 at an intermediate point.

The weft severing device also includes a guide duct 6 (only partially shown) by means of which the weft thread 5 is conveyed from the tube 2 to a shed 7 of a weaving rotor 8 (only partially shown). As indicated, the rotor 8 rotates in a direction indicated by an arrow 9. As the rotor 8 rotates, the weft thread 5 is drawn over an edge 10 at the mouth of the tube 2.

The severing device also includes a cutting element 14 which is mounted in stationary fashion in the support. This stationary cutting element 14 includes a bore 13 for slidably receiving the mouth of the blowing tube 2 and about which a cutting edge 15 is formed.

The severing device also has a means 11 in the form of a pivot lever for moving the blowing tube 2 towards and away from the cutting element 14 in order to effect severing of the weft thread 5 between the tube 2 and the cutting element 14.

In use, as shown in FIG. 1, a weft thread 5 is drawn into the blowing tube 2 and pneumatically conveyed directly from the blowing tube 2 into the guide duct 6 and, thence, through the shed 7 which is formed, for example by means of a suitable comb on the rotor 8. As the weft thread 5 is being conveyed through the shed 7, the rotor 8 rotates, for example into the position illustrated in FIG. 2. At this time, the weft thread 5 passes over the edge 10 at the mouth 12 of the tube 2, i.e. transversely of the tube 2. In addition, the thread has been passed out of the guide duct 6 which is otherwise constructed to permit movement of the weft thread 5 out of the confines of the guide duct 6 at this time.

Figure 2:
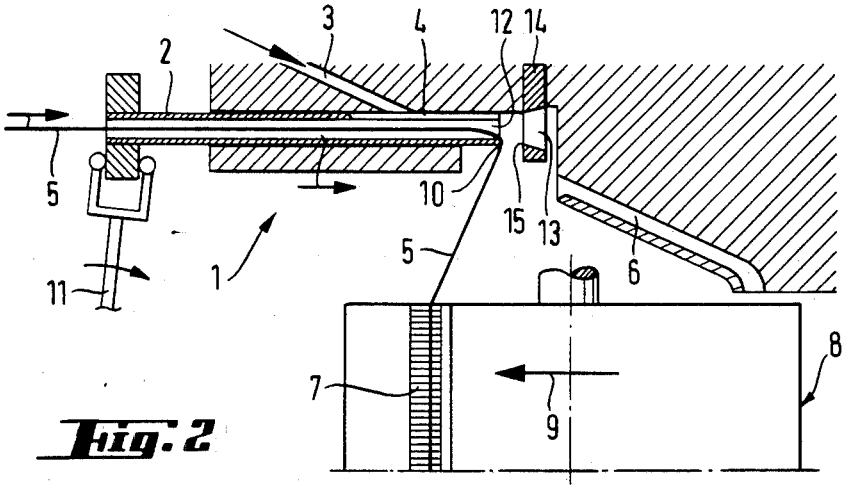
FIG. 2 illustrates a cross-sectional view of the shear of FIG. 1 in an intermediate position.
Figure 3:
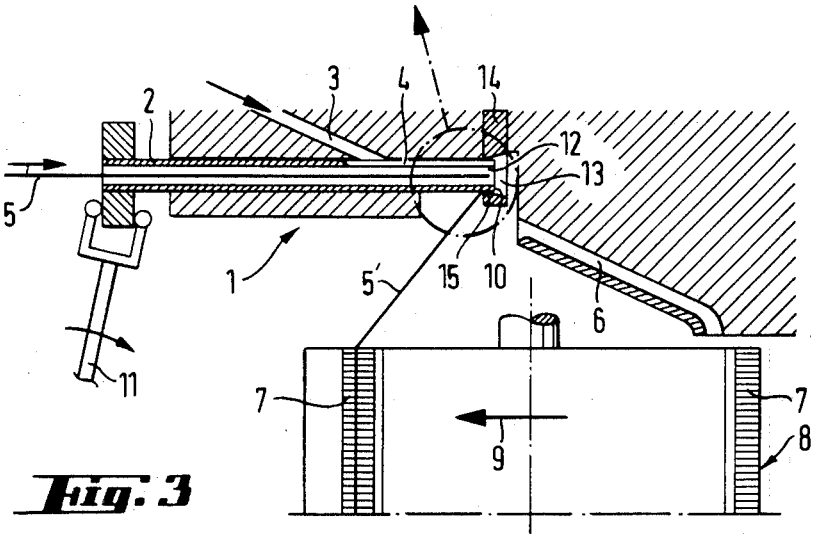
FIG. 3 illustrates a cross-section view of the shear of FIG. 1 in a position immediately after severance of a weft thread.
Figure 4:
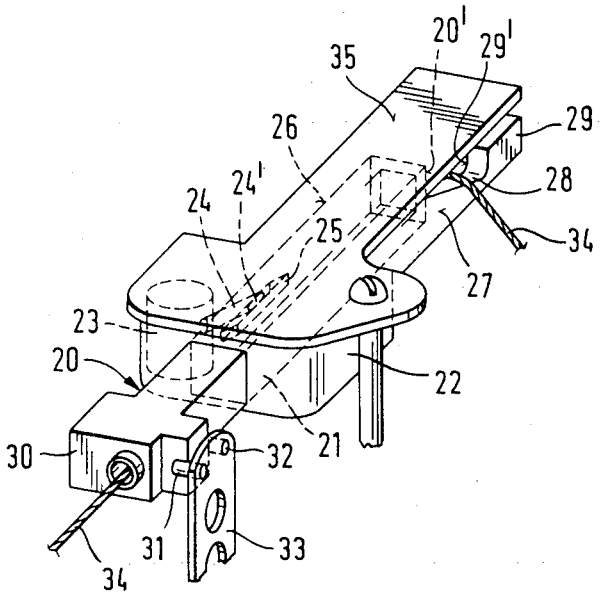
FIG. 4 illustrates an enlarged detailed view of FIG. 3 of the blowing tube and cutting element in accordance with the invention.

As the rotor 8 rotates from the position indicated in FIG. 1 to the position indicated in FIG. 2, the lever 11 moves the blowing tube 2 towards the cutting element 14. Continued rotation of the rotor 8 and movement of the blowing tube 2 causes the blowing tube 2 to be moved into the bore 13 of the cutting element 14 as indicated in FIGS. 3 and 4. As the cutting edge 15 of the element 14 is passed over, the weft thread 5 is severed between the cutting edge 10 of the blowing tube 2 and the cutting edge 15. The trailing end of the severed weft thread 5 is then entrained by the rotor 8 and subsequently severed in any known manner.

Immediately after severing of the weft thread 5, the lever 11 returns the tube 2 to the initial position illustrated in FIG. 1. At the same time, the forward end 16 of the weft thread 5 is retained by the air streaming through the tube 2 and is conveyed forwardly into the guide duct 6 and, thence, to the rotor 8 for the start of the next pick.

As indicated in FIG. 4, the cutting element is in the form of a plate with a bore 13. However, the cutting element 14 need not be engaged around the end of the blowing tube 2 during severance. Instead, it is sufficient for the end 12 of the blowing tube 2 to move over the cutting edge 15. Alternatively, the cutting element 14 may be movable relative to the blowing tube 2. In this case, the blowing tube 2 would be held stationary. Another alternative is for the blowing tube 2 and the cutting element 14 to be movable relative to one another.

Figure 5:
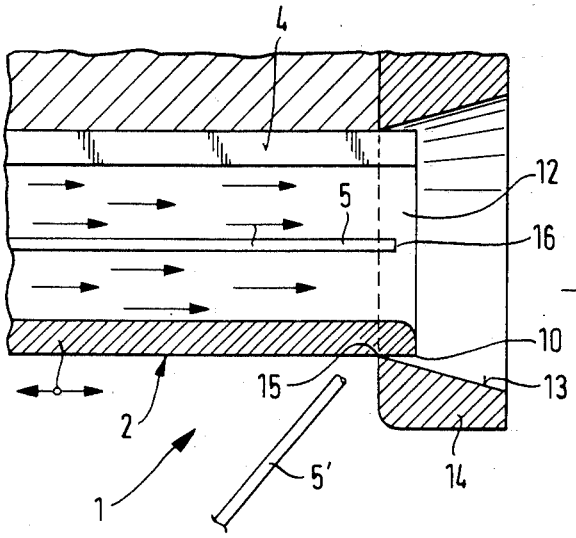
FIG. 5 illustrates a perspective view of a modified weft severing device according to the invention.

Referring to FIG. 5, the weft severing device may also be constructed with a guide element 22 in which a rectangular section blowing tube 20 is slidably mounted in a rectangular section duct 21 of the guide element 22. As indicated, the guide element 22 includes means for delivering a flow of compressed air into the tube 20 for conveying a thread 34 therethrough. For example, this means includes a bore 23 in the guide element 22 for supplying blowing air and a duct 24 which branches off from the bore 23 to terminate at a point 24′ which is aligned with an elongated slot 25 in a wall 26 of the tube 20.

The blowing tube 20 is provided with a cutting edge 20′ at the mouth piece end. As illustrated in FIG. 5, the cutting edge 20′ is vertically disposed.

The severing device also has a cutting element 29 which extends from a side wall 27 of the guide element 22. As indicated, the cutting element 29 has a recess 28 which is disposed transversely of the tube mouth for passage of the weft thread 34 therethrough. In addition, the cutting element 29 has a cutting edge 29′ at the recess 28 which faces towards the cutting edge 20′ of the blowing tube 20.

The severing device also has a means for moving the tube 20 towards the stationary cutting element 29 in order to sever the thread 34. To this end, the means includes a lever 33 which carries a pair of pins 31, 32 which are disposed on opposite sides of an enlarged shoulder at the rear end 30 of the tube 20.

In use, the weft thread 34 for picking is sucked by the blowing air entering the tube 20 from the duct 24 and supplied through the tube 20 by way of a picking device (not shown) to a weaving rotor (not shown). When the weft thread 34 is to be severed, the thread issues through the recess 28 and is drawn by the weaving rotor (not shown) over the cutting edge 29′. As illustrated, this cutting edge 29′ is curved. The blowing tube 20 is also moved forwardly by the lever 33 and the weft thread 34 is severed by the respective cutting edges 29, 29′.

Of note, the described shear can be combined with a plurality of other similar shears to form a single cutting device. As many shears are provided as required to pick wefts, for instance, four or six, depending upon the construction of the weaving rotor. The shears may be staggered one on another and retained by a plate 35 as indicated in FIG. 5.

Although the severing device has been described with reference to a superposed shed type weaving machine, the severing device may also be used for other kinds of weaving machines, such as gripper projectile machines and, in general, whenever a weft thread is to be severed without stopping its movement.

The invention thus provides a severing device which is able to sever a travelling weft thread without need to stop the weft thread. Further, the invention provides a severing device which can be readily employed on a superposed shed type weaving machine. Still further, the invention provides a weft severing device which is of minimal weight and of relatively simple construction.

What is claimed is:

1. A weft severing device for a weaving machine comprising a blowing tube for pneumatically conveying a to be inserted weft thread therethrough;

a cutting element for severing a weft thread extending out of said tube in cooperation with said blowing tube; and means for moving at least one of said tube and said element relative to each other to effect severing of a weft thread between and by said tube and said element.

2. A weft severing device as set forth in claim 1 wherein said tube has a mouth at one end for passage of weft thread and said cutting element is a plate having a bore for receiving said mouth of said tube and a cutting edge about said bore for severing a thread extending between said mouth and said edge.

3. A weft severing device as set forth in claim 1 which further comprises a guide element having said tube slidably mounted therein and said cutting element extending therefrom, said guide element having a duct for receiving compressed air and communicating with a slot in said tube to deliver compressed air thereto;

a first cutting edge at an exit end of said tube; and a second cutting edge on said cutting element facing said first cutting edge to sever a weft thread therebetween.

4. In combination, a weft severing device including a blowing tube for pneumatically conveying a weft thread therethrough, a cutting element for severing a weft thread extending out of said tube and means for moving at least one of said tube and said element relative to each other to sever a weft thread therebetween; and a guide duct spaced from said tube to receive a pneumatically conveyed weft thread therefrom with said cutting element disposed between said tube and said guide duct.

5. The combination as set forth in claim 4 wherein said severing device includes a guide element having said tube slidably mounted therein and said cutting element extending therefrom.

6. The combination as set forth in claim 5 wherein said guide element includes means for delivering a flow of compressed air into said tube for conveying a thread therethrough.

7. A weft severing device comprising a guide element;

a tube slidably mounted in said guide element for pneumatically conveying a weft thread therethrough, said tube having a mouth at one end and a cutting edge disposed at said tube; and means for moving said tube within said guide element towards said cutting element to sever a thread extending from said tube between said cutting edges.

8. A weft severing device as set forth in claim 7 wherein said guide element includes means for delivering a flow of compressed air into said tube for conveying a thread therethrough.

9. A weft severing device as set forth in claim 7 wherein said cutting element extends from said guide element and has a recess disposed transversely of said tube mouth for passage of a thread from said tube therethrough.

* * * * *